US006283713B1

(12) United States Patent
Harvey et al.

(10) Patent No.: US 6,283,713 B1
(45) Date of Patent: Sep. 4, 2001

(54) BLADED DUCTING FOR TURBOMACHINERY

(75) Inventors: Neil W Harvey; Martin G Rose, both of Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/425,615

(22) Filed: Oct. 22, 1999

(30) Foreign Application Priority Data

Oct. 30, 1998 (GB) ..... 9823840

(51) Int. Cl.[7] ..... F10D 5/22

(52) U.S. Cl. ..... 416/193 A; 415/914; 415/191; 416/248

(58) Field of Search ..... 415/914, 191; 416/191, 193 A, 248

(56) References Cited

U.S. PATENT DOCUMENTS

| | | | | |
|---|---|---|---|---|
| 2,735,612 | * | 2/1956 | Hausmann | 415/208.1 |
| 4,194,869 | | 3/1980 | Corcokios . | |
| 4,465,433 | * | 8/1984 | Bischoff | 416/223 A |
| 4,668,164 | | 5/1987 | Neal . | |
| 5,397,215 | * | 3/1995 | Spear et al. | 415/191 |
| 6,017,186 | * | 1/2000 | Hoeger et al. | 415/181 |

FOREIGN PATENT DOCUMENTS

| | | |
|---|---|---|
| 2079399 A | 1/1982 | (GB) . |
| 2114263 A | 8/1983 | (GB) . |
| 2281356 A | 3/1995 | (GB) . |

* cited by examiner

*Primary Examiner*—Edward K. Look
*Assistant Examiner*—Ninh Nguyen
(74) *Attorney, Agent, or Firm*—W. Warren Taltavull; Manelli Denison & Selter PLLC

(57) ABSTRACT

An axial flow turbomachine has at least one circumferential row of aerofoil members in which at least one of the two end walls (33) between successive blades (30) is given a non-axisymmetric profile to modify the boundary layer flow at the wall. In one form of the profile, a convex region (33) adjacent each member pressure surface (35) and a complementary concave region (34) adjacent each member suction surface (34) extend over at least a major part of the blade chord lengths to reduce the transverse pressure gradient and thereby reduce vortical energy losses. In another form of the profile, at least one end wall (33) has complementary convex and concave regions (50,51) extending through the zone of the trailing edges of the members (30) on the suction end pressure surface sides (34,35) respectively of each member, thereby to reduce over turning of the flow. Both forms of profiling can be employed in combination.

12 Claims, 3 Drawing Sheets

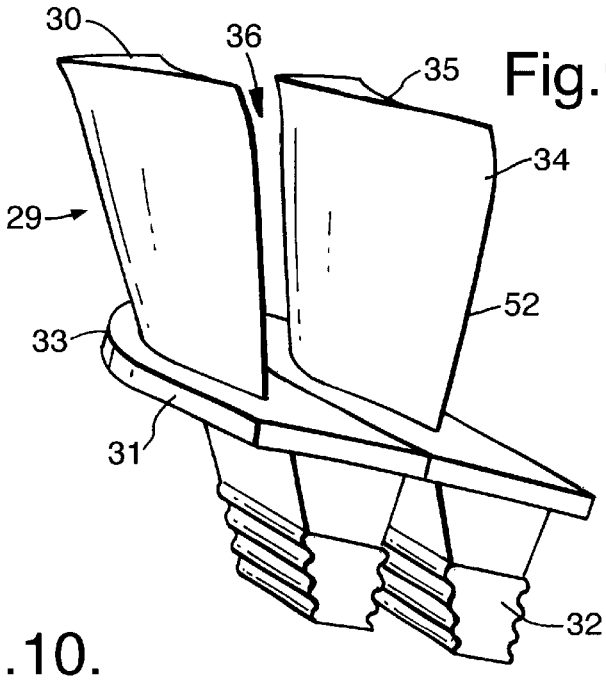
Fig.9.
Fig.10.
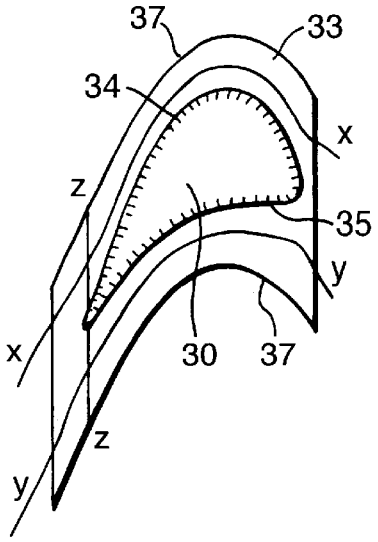
Fig.11.
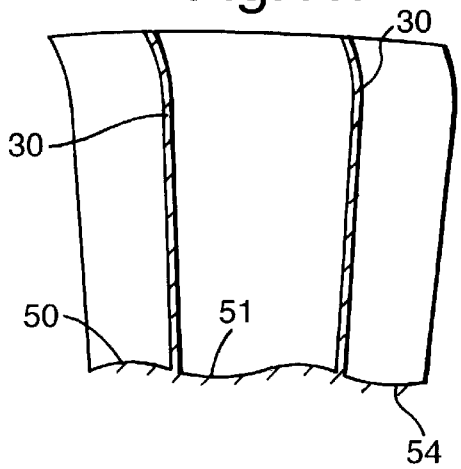
Fig.12.
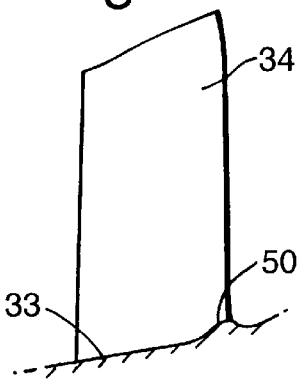
Fig.13.
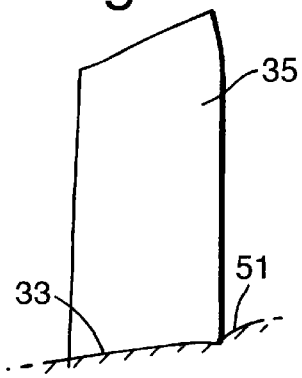

BLADED DUCTING FOR TURBOMACHINERY

THE FIELD OF THE INVENTION

This invention relates to turbomachinery in which there are one or more rows of generally radially extending aerofoil members in an annular duct through which a compressible fluid flows. The invention is particularly concerned with improving the control of the fluid flow past rows of such aerofoil members, which may be fixed vanes or blades rotating about the central axis of the duct.

BACKGROUND OF THE INVENTION

Each row of aerofoil members divides the duct into a series of sectoral passages, each bounded by the opposed suction and pressure surfaces of an adjacent pair of members and the radially inner and outer walls of the duct. The flow field within the sectoral passages is complex and includes a number of secondary vortical flows which are a major source of energy loss. Reference can be made to Sieverding (1985) "*Secondary Flows in Straight and Annular Turbine Cascades*", *Thermodynamics and Fluids of Turbomachinery, NATO,* Vol. 11, pp 621–624 for a detailed discussion of these flows. Their relative importance increases with increase of aerodynamic duty or decrease of aspect ratio. Not only is there energy dissipation in the secondary flows themselves, but they can also affect adversely the fluid flow downstream because they cause deviation of the exit angles of the flow from the row of aerofoil members.

It is found that it is the end wall boundary layers that give rise to a substantial part of these secondary flows. FIG. 1 shows a flow model illustration taken from Takeishi et al (1989), "*An Experimental Study of the Heat Transfer and Film Cooling on Low Aspect Ratio Turbine Nozzles*" ASME Paper 89-GT-187. This shows part of a row of turbine blades projecting from a cylindrical surface that forms a radially inner end wall of the annular passage into which the blade aerofoil extends. The principal flow features as shown in the model are:

(i) Rolling up of the inlet boundary layer L into a horseshoe vortex H at the blade leading edge due to the pressure variation at the intersection of the leading edge and the end wall. The pressure surface side leg of this flow becomes the core of a passage vortex P which is a dominant part of the secondary flow. On the end wall beneath the passage vortex a new boundary layer is formed, indicated as cross-flow B, which starts in the pressure side corner of the end wall of the blade passage.

(ii) Upstream of the crossflow B the inlet boundary layer is deflected across the passage, as indicated by cross-flow A. The end wall separation line S marks the furthest penetration of the bottom of the inlet boundary layer A into the blade passage and divides it from the new boundary layer (crossflow B) forming downstream of it.

(iii) The new end wall boundary layer, crossflow B, continues onto the blade suction surface until it separates, along an aerofoil separation line V, and feeds into the passage vortex P. The horseshoe vortex suction side leg, referred to as the counter vortex U in the drawing, remains above the passage vortex P and moves away from the end wall as the passage vortex grows.

(iv) A small corner vortex C may be initiated in the corner region between the blade suction surface and the end wall, rotating in the opposite sense to the passage vortex.

(v) Also illustrated in FIG. 1 are the attachment line T which represents the division of the incoming boundary layer flow L between adjacent passages, and the saddle point D, where the attachment line T and the end wall separation line S intersect.

Typically, the passage vortex will increase the exit angle of the flow at the end wall (referred to as "over turning") with the compensatory reduction in exit angle away from the wall (referred to as "under turning"). These effects give rise to deviations of the inlet flow to the next aerofoil row, causing the angle of incidence of the flow on the aerofoils to vary positively or negatively from the design value and so reduce the aerodynamic efficiency of the flow.

There have been a number of proposals for reducing the secondary flows in the sectoral passages of a turbomachine, but with limited results. In recent work (Schnaus et al (1997), "Experimental and Numerical Investigation of the Influence of Endwall Inclination and Contouring on the Flow Field in a Highly Loaded Turbine Cascade" *ISABE* 97-7117, and Duden et al (1998), "Controlling the Secondary Flow in a Turbine Cascade 3D Airfoil Design and Endwall Contouring", *ASME* 98-GT-72), an axisymmetric profile was applied to the inclined end wall of a rotor blade in linear cascade which, unlike previous work did not change the inlet-to-exit passage area ratio. This profiling resulted in a small reduction in exit flow angle deviations and no change in loss. When combined with compound leaning and thickening of the aerofoil near the end wall, there was a significant reduction in secondary loss which, although counterbalanced by higher profile losses, still gave a significant reduction in exit angle deviations.

Non-axisymmetic end wall profiling has been attempted also. Atkins (1987), "Secondary Losses and End-wall Profiling in a Turbine Cascade" *I Mech. E* C255/87, pp29–42, describes two non-symmetric end wall profiles, both raised to one side, at the blade pressure surface or suction surface respectively but reducing to an unprofiled contour at the opposite blade surface, with the intention of reducing the maximum or minimum pressure on the relevant blade surface. Both profiles resulted in an overall increase in losses due to adverse effects on the flow near the profiled end wall causing separation and strong twisting of the blade wake. Morris et al (1975), "Secondary Loss Measurements in a Cascade of Turbine Blades with Meridional Wall Profiling", *ASME* 75-WA/GT-30 describes comparative tests of axisymmetric and non-axisymmetric profiles. In the non-axisymmetric case the contours were normal to a mid-passage streamline lying midway between the camber lines of the two blades bounding each blade passage, thereby raising the passage height over the entire width but with different chord-wise profiles. Although a better loss reduction was obtained at the unprofiled wall in the non-axisymmetric case, this advantage was cancelled by adverse effects close to the profiled wall and very strong twisting of the blade wake.

SUMMARY OF THE INVENTION

According to one aspect of the present invention, there is provided at least one circumferential row of generally radially extending aerofoil members for location in an annular duct of a turbomachine for a flow of a compressible fluid through sectoral passages bounded by respective pressure and suction surfaces of adjacent aerofoil members, said row comprising at least one radial end wall, said at least one radial end wall in each said passage between said aerofoil member surfaces having a non-axisymmetric cross-section formed by a convex profiled region immediately adjacent the member pressure surface and a concave profiled region immediately adjacent the member suction surface, said regions extending over at least the major part of the chord of the respective aerofoil members, whereby to reduce the pressure gradient in the flow over said end wall in a direction transverse to the passage.

By reducing the pressure gradient between the opposed aerofoil member surfaces, the generation of the passage vortex can be delayed and the energy losses in the resulting vortical flows can be reduced.

The profiled convex and concave regions may be formed on either or both of the inner and outer radial end walls of the passages. If the aerofoil members are blades mounted on a rotary hub, however, because the profiling is non-axisymmetrical, the row will be provided with a co-rotating shroud if it is to have a profiled outer end wall.

It is desirable to arrange that the convex and concave regions are complementary to each other so that the profiling does not significantly change the passage cross-sectional area. That is to say, as compared with a non-profiled axisymmetric duct, the increase of cross-sectional area given by the concave regions is essentially balanced by the decrease of cross-sectional area given by the convex regions. However, the form of the end wall profiling can vary. For example, the different blade loadings of typical compressor rows and turbine rows will influence the chordwise location of the raised and depressed regions.

Generally, the or each said end wall profiling will begin close to, or even ahead of the leading edges of the aerofoil members of the row. When the flow entering the row is axial or at a small angle to the axial direction, the maxima of the convex and concave formations will be in the rear half of the aerofoil member chord, but it will move further forwards as the entry flow angle increases, for example, to the front half length of the chord. Where the axial length of the row end wall permits, the profiling may extend upstream of the leading edges of the aerofoil members and/or downstream of their trailing edges.

Preferably, the concave region adjacent the suction surface gives an obtuse angle at the junction of the end wall and that surface over at least a part of the length of the concave region.

As mentioned already, the secondary flows in a sectoral passage between adjacent aerofoil members also cause deviations of the exit flow from the row. Specifically, the new end wall boundary layer, cross-flow B in FIG. 1, is over turned, which increases the exit angle at the wall. The flow then meets the next row of aerofoil members at a greater angle of incidence than designed, so that the efficiency of that following row is reduced.

In another aspect of the present invention, there is provided at least one row of generally radially extending aerofoil members for location in an annular duct of a turbomachine for a flow of compressible fluid through sectoral passages bounded by respective pressure and suction surfaces of adjacent aerofoil members, said row comprising at least one radial end wall, said at least one radial end wall of each said passage between said aerofoil member surfaces having, in a region extending through the zone of the trailing edges of the members, a non-axisymmetric cross-section formed by a raised convex profiled region adjacent the suction surface and a depressed concave profiled region adjacent the pressure surface.

With such a configuration, the static pressures on the aerofoil member surfaces near the trailing edge can be modified so as to generate a displacing force urging the flow from the pressure side towards the suction side. The degree of over turning can then be reduced as this acts in opposition to the over turned end wall boundary layer.

Preferably, the raised and depressed regions have profiles that in the circumferential direction exhibit an inflected or undulating transverse cross-sectional profile, with the raised convex region forming an acute-angled junction with the aerofoil member suction surface and the depressed concave region forming an obtuse-angled junction with the pressure surface. Generally, the raised and depressed regions will extend downstream of the member trailing edges and the points of maximum amplitude of these regions may lie within a region extending approximately 15% of the member axial chord upstream and downstream of the trailing edge plane.

It is also possible, within the scope of the invention, to combine, in the same row of aerofoil members, both non-axisymmetric formations of the two aspects of the invention referred to above.

BRIEF DESCRIPTION OF THE DRAWINGS

In the accompanying drawings:

FIG. 9 is an oblique rear view of a pair of blades in turbine row of the gas turbine of FIG. 2 in another embodiment of the invention, in the region of an inner end wall of the row, FIGS. 10 and 11 are, respectively, a radial end view of one of the blades in FIG. 9 and a transverse cross-section on the line Z—Z in FIG. 10, and FIGS. 12 and 13 are views on the suction and pressure surfaces respectively, adjacent the end wall, of one of the blades in FIG. 9.

DETAILED DESCRIPTION OF THE INVENTION

The invention will now be further described by way of example, firstly with reference to the embodiment of FIGS. 2 to 8 of the drawings.

Figure 2:
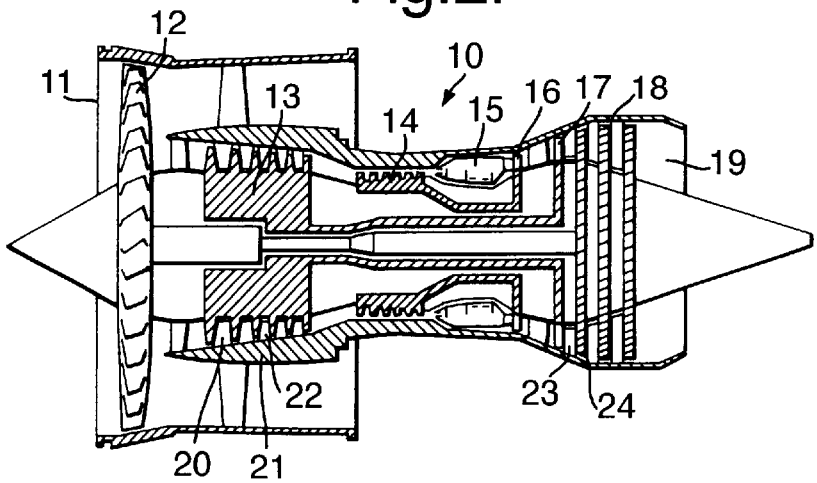
PRIOR ART Fig.2.
FIG. 2 is a schematic axial section of a ducted fan, axial flow gas turbine which incorporates the present invention.

The gas turbine 10 of FIG. 2 is one example of a turbomachine in which the invention can be employed. It is of generally conventional configuration, comprising an air intake 11, ducted fan 12, intermediate and high pressure compressors 13,14 respectively, combustion chambers 15, high medium and low pressure turbines 16,17,18 respectively, rotating independently of each other and an exhaust nozzle 19. The intermediate and high pressure compressors 13,14 are each made up of a number of stages each formed by a row of fixed guide vanes 20 projecting radially inwards from the casing 21 into the annular gas passage through the compressor and a following row of compressor blades 22 projecting radially outwards from rotary drums coupled to the hubs of the high and medium pressure turbines 16,17 respectively. The turbines similarly have stages formed by a row of fixed guide vanes 23 projecting radially inwards from the casing 21 into the annular gas passages through the turbine and a row of turbine blades 24 projecting outwards from a rotary hub. The high and medium pressure turbines 16,17 are single stage units. The low pressure turbine 18 is a multiple stage unit and its hub is coupled to the ducted fan 12.

Figure 3:
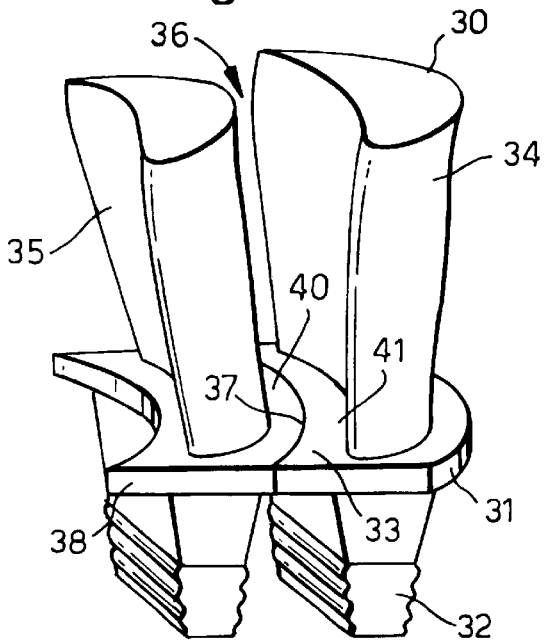
FIG. 3 is an oblique front view of a pair of blades in a turbine row of the gas turbine illustrating an embodiment of the invention in the region of an inner end wall of the row.
Figure 4:
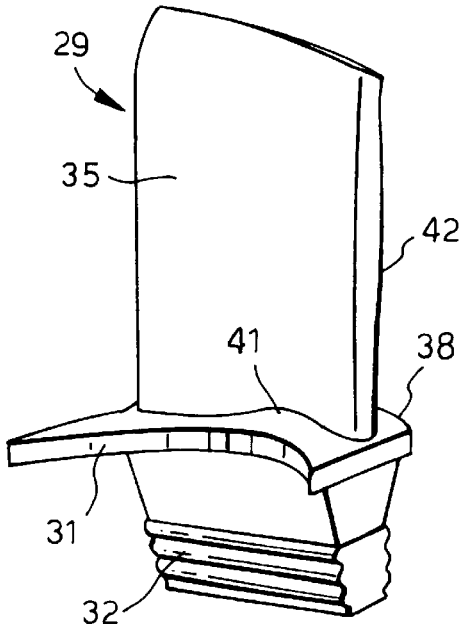
FIG. 4 is a similar view to FIG. 3, but to a different perspective of one of the blades of the row.
Figure 5:
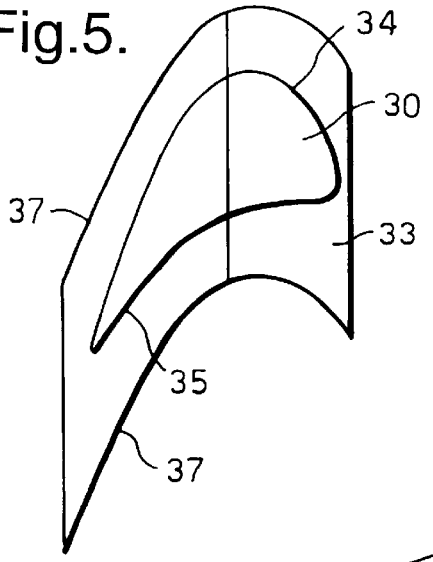
FIGS. 5 and 6 are, respectively, a radial end view of one of the blades in FIG. 2, a modification also being illustrated in FIG. 6, FIGS. 7 and 8 are views of the suction and pressure surfaces respectively of one of the blades in FIG. 3, adjacent the end wall, illustrating further the extent of the profiling of the end wall at the base of the blade.

FIGS. 3 to 8 show fragmentarily one of the turbine blade rows 24. Each blade 29 comprises an aerofoil member 30, a sectoral platform 31 at the radially inner end of the member, and a root 32 for fixing the blade to its hub. The platforms 31 of the blades abut along rectilinear faces (not shown) to form an essentially continuous inner end wall 33 of the turbine annular gas passage which is divided by the blades into a series of sectoral passages 36. The aerofoil members 30 have a typical cambered aerofoil section with a convex suction surface 34 and a concave pressure surface 35. FIG. 3 indicates mid-camber lines 37 of adjacent sectoral passages, equidistant from the camber lines of the pairs of aerofoil members 30 bounding the passages.

Figure 7:
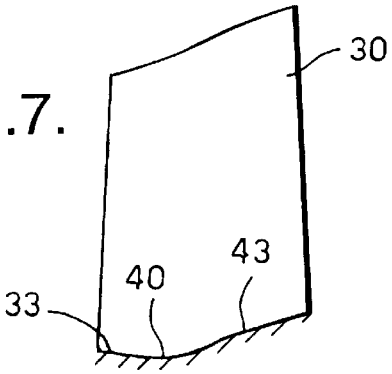
Figure 8:
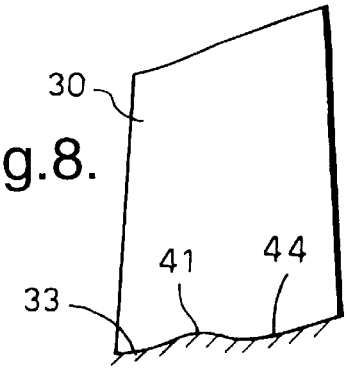

In the example illustrated, at the leading edges 38 of the platforms 31 the inner wall is axisymmetrical, ie. having a circular cross-section. Further rearwards, the platforms are smoothly profiled to give the end wall 33 an elongate radial depression or trough 40 between the mid-camber line 37 and the suction surface 34 of each blade and an elongate radial projection or hump 41 between the mid-camber line 37 and the pressure surface 35 of each blade. Both the trough 40 and the hump 41 begin a short distance rearwards of the leading edges 42 of the blades and have their maxima in the front half chord length of the blades. They blend with an axisymmetric rear region of the end wall 33 through portions of reverse curvature 43,44, near the trailing edges of the blades, as can be seen in FIGS. 7 and 8.

Figure 6:
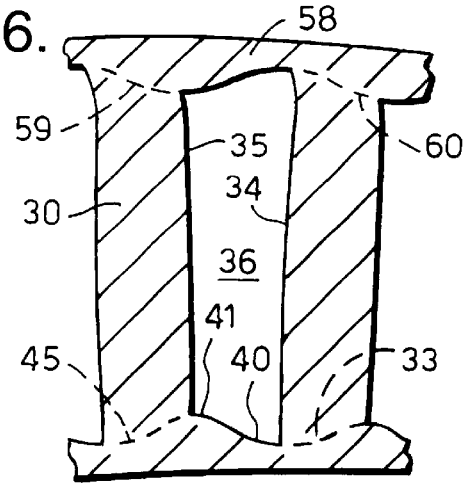

In transverse cross-section, as shown by FIG. 6, the troughs 40 and humps 41 give the end wall 33 an undulating cross-sectional profile 45 which, at any axial station, is circumferentially periodic in phase with the blade pitch, and in which profile the areas of the troughs and the humps essentially balance each other. A concave part of the profile extends from the base of the aerofoil member at its suction surface and a convex part of the profile extends from the base at the pressure surface. Preferably, the concave profile meets the blade surface at an obtuse angle.

The effect of each hump 41 is to generate a local acceleration of the fluid flow, with an accompanying decrease in static pressure adjacent to the pressure side of the passage. This acts counter to the effect of the adjacent concave pressure surface which generates a local diffusion of the flow and increase of static pressure. Similarly, each trough 40 gives rise to a local increase of static pressure adjacent to the suction side of the passage acting counter to the local pressure decrease generated by the convex suction surface.

Figure 1:
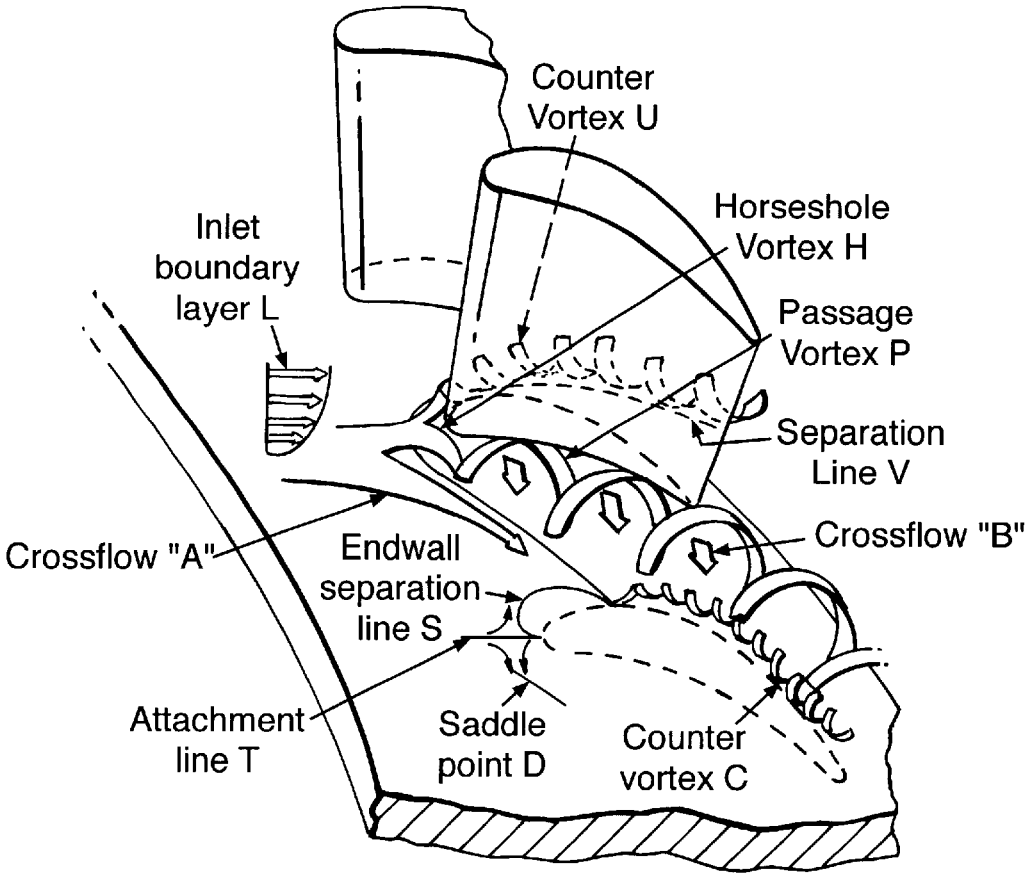
FIG. 1 is an illustration of the Takeishi end wall secondary flow model.

By influencing the local pressures with the profiling described, the over turning of the inlet boundary layer, ie. the cross-flow A of FIG. 1, and thus its rolling up into the passage vortex, is delayed. This leads to a reduction of the velocities of the over turned end wall boundary flows both at the inlet (cross-flow A) and in the new boundary layer formed further downstream (cross-flow B) so lowering the secondary kinetic energy of the passage vortex and the associated energy loss. The reduced secondary kinetic energy of the passage vortex and its delayed development also result in reduced secondary flow deviations in the passage flow. In addition, further control of the end wall boundary layer parameters becomes possible, including skin friction coefficient and surface heat transfer.

Experimental test results have indicated that significant reductions can be achieved in the loss coefficient (CpO), the secondary flow deviations, as measured by the exit angle, and the secondary kinetic energy loss.

In the embodiment of FIGS. 9 to 13, as in the preceding example, portions of a turbine blade row of the gas turbine 10 are shown and parts corresponding to those already described are indicated by the same reference numbers. The individual blades 29 have roots 32 for fixing to a rotor hub and the aerofoil members 30 of the blades have a typical cambered section with a convex suction surface 34 and a concave pressure surface 35. At the base of each aerofoil member the blade has an integral platform 31, the inner end wall 33 of the annular gas passage through the blade row being formed by the abutting platforms of the blades. The annular gas passage is divided by the blades into a series of sectoral passages 36. The lines X—X and Y—Y in FIG. 10 over the axial length of the blade row, lie mid-way between the surfaces of the blade shown and the mid-passage lines to each side of it, which are themselves the mean camber lines 37 of two adjacent blades of the row.

As in the first embodiment, the inner end wall 33 of each sectoral passage is given a non-axisymmetric profile. In this instance the end wall profiling is intended to achieve a reduction in the over-turning of the exit flow from the end wall and is located in the region of the trailing edges of the blades. On the suction surface side of the sectoral passage, from the mid-camber line 37 the end wall has an elongate radial projection or hump 50, while on the pressure surface side of the passage from the mid-camber line 37, the end wall has an elongate radial depression or trough 51. These projections and depressions are preferably complementary, ie. they leave the cross-sectional areas of the sectoral passages essentially unchanged. In the illustrated example, the maximum height of the hump and the maximum depth of the trough is approximately at the blade trailing edge 52, but these maximum amplitudes can occur within 15% of the blade chord to either side of the trailing edge. The maxima also are in regions of minimum radius of curvature, forwards and rearwards of which the profiling is more gently blended into the main profile of the end wall 33.

As FIG. 11 shows in transverse cross-section at the trailing edge plane, the humps 50 and troughs 51 have a smoothly curved profile 54 and their maxima are at a small spacing from the adjacent blade surfaces. Thus, the hump or projection close to the suction surface 35 has a decreasing height as it approaches the blade, so that the surfaces meet at an acute angle. Conversely, at the pressure surface 34 the blade and trough surfaces meet at an obtuse angle.

The effect of the humps 50 and troughs 51 is to raise the local static pressure on the pressure side of each sectoral passage at the trailing edge and lower it on the suction side, thereby urging flow to move round the blade trailing edge from pressure to suction side. In conjunction with the small corner vortex (see the Takeishi model in FIG. 1) this flow opposes the over turned end wall boundary layer and reduces the degree of over turning. As a result, the circumferentially averaged secondary flow deviation at the end wall exit region is reduced. It is also possible to achieve better control of such end wall boundary layer parameters as skin friction coefficient and surface heat transfer.

The effects of the profiling in this second example also tend to increase aerodynamic loss in the aerofoil member row, but this can be accepted if it is sufficiently outweighed by the improved flow conditions that are obtained in the following row from reduction of the over turning. It has to be mentioned also that the contouring tends to increase pressure variation circumferentially at the exit from the row, so a greater pressure must be maintained between the rotor disc and following row of stator vanes to control leakage, but in appropriate circumstances an overall efficiency gain can be achieved.

Although both the examples described above refer only to profiling of the inner end walls of the sectoral passages in a turbine blade row, it will be understood that if a co-rotating outer end wall of the row is provided by a circumferential shroud continuous with the outer tips of the aerofoil members, that outer wall can be similarly profiled. This is illustrated in FIG. 6 where a shroud 58 provides an outer end wall 59, with profiling comprising outwardly directed depressions or troughs 60 adjacent the aerofoil suction surfaces and inwardly directed projections or humps 61 adjacent the aerofoil pressure surfaces. The shroud 58 can be constructed in known manner from a series of abutting sectoral elements that are integral with individual or groups of blades of the row.

It is of course also possible within the scope of the invention to provide a row of aerofoil members with a profiled outer end wall and an axisymmetric inner end wall.

It will be further apparent that the end wall profiling in accordance with the invention can be applied to the rows of blades 22 of the compressors 13,14 of the gas turbine in the same manner as for the turbine blade rows illustrated, and similarly to the static rows of compressor guide vanes 20 or turbine guide vanes 23. The illustrated examples can also be seen as instances of these further possibilities. As will be understood, differences in the aerodynamic duty in each case will determine the form and extent of the profiling. Thus the axial flow onto a turbine entry guide vane row will require the cross-flow reduction profiling exemplified in the embodiment of FIGS. 3–8 to be positioned at least mainly in the rear half of the blade chords, whereas the angled entry flows further downstream will require the profiling to be positioned further forwards.

It will also be understood that the two embodiments shown with reference to FIGS. 3–8 and FIGS. 9–13 respectively can give complementary benefits and it is possible to use both forms of profiling according to the invention in combination, although for clarity of illustration this has not been shown.

What is claimed is:

1. A circumferential row of generally radially extending aerofoil members for location in an annular duct of a turbomachine for a flow of a compressible fluid through sectoral passages bounded by respective pressure and suction surfaces of adjacent aerofoil members, said row comprising at least one radial end wall, said at least one radial end wall in each said passage between said surfaces having a non-axisymmetrical cross-section formed by a convex profiled region immediately adjacent the aerofoil member pressure face and a concave profiled region immediately adjacent the aerofoil member suction face, said regions extending over at least the major part of the chord of the respective aerofoil members, whereby to reduce the pressure gradient in the flow over said end wall in a direction transverse to the passage.

2. A row of aerofoil members according to claim 1 wherein said end wall has an axisymmetric cross-section at the leading edge of said end wall.

3. A row of aerofoil members according to claim 1 wherein said end wall has an axisymmetric surface downstream of said convex and concave regions.

4. A row of aerofoil members according to claim 1 wherein said profiled end wall is formed by surfaces of platforms that are integral with the members of the row.

5. A row of aerofoil members according to claim 1 wherein the members project from a rotary turbine hub and are provided with an outer circumferential shroud rotatable with the members and forming an outer end wall of said passages, at least said outer end wall being provided with said profiled regions.

6. A row of aerofoil members according to claim 4 wherein said convex and concave regions of the end wall have a maximum radial extent in the forward half of the chord length of the blades.

7. A row of aerofoil members according to claim 1 where the members are stator vanes and the sectoral passages are bounded by radially inner and outer end walls, both of which are provided with said convex profiled regions.

8. A row of aerofoil members according to claim 1 wherein the members are stator vanes and said profiled regions extend beyond at least one of the leading and trailing edges of the members.

9. A row of aerofoil members according to claim 1 in combination with said row comprising at least one radial end wall, said at least one radial end wall of each said passage between said aerofoil member surfaces having, in a region extending through the zone of the trailing edges of the members, a non-axisymmetric cross-section formed by a raised convex profiled region adjacent the suction surface and a depressed concave profiled region adjacent the pressure surface.

10. An aerofoil member for a row according to claim 1 wherein said member is provided with an integral portion extending transversely to said pressure and suction surfaces at least at one radial end of the member for forming at least a portion of the profiling of said radial end wall.

11. A circumferential row of generally radially extending aerofoil members for location in an annular duct of the turbomachine for a flow of compressible fluid through sectoral passages bounded by respective pressure and suction surfaces of adjacent aerofoil members, said row comprising at least one radial end wall, said at least one radial end wall of each said passage between said aerofoil member surfaces having, in a region extending through the zone of the trailing edges of the members, a non-axisymmetric cross-section formed by a raised convex profiled region adjacent the suction surface and a depressed concave profiled region adjacent the pressure surface, each convex region forming an acute-angled junction with the member suction surface.

12. A circumferential row of generally radially extending aerofoil members for location in an annular duct of the turbomachine for a flow of compressible fluid through sectoral passages bounded by respective pressure and suction surfaces of adjacent aerofoil members, said row comprising at least one radial end wall, said at least one radial wall of each said passage between said aerofoil member surfaces having, in a region extending through the zone of the trailing edges of the members, a non-axisymmetric cross-section formed by a raised convex profiled region adjacent the suction surface and a depressed concave profiled region adjacent the pressure surface, each concave region forming an obtuse-angled junction with the member pressure surface.

* * * * *